US006752040B1

(12) United States Patent
Paul-Alexandre et al.

(10) Patent No.: US 6,752,040 B1
(45) Date of Patent: Jun. 22, 2004

(54) CONTAINER OPENER

(76) Inventors: Raoul Paul-Alexandre, 5 Ash La., Lake Hiawatha, NJ (US) 07034; Anthony Cifelli, 150 Pine Brook Rd., Montville, NJ (US) 07045

( * ) Notice: Subject to any disclaimer, the term of this patent is extended or adjusted under 35 U.S.C. 154(b) by 0 days.

(21) Appl. No.: 10/336,891

(22) Filed: Jan. 7, 2003

(51) Int. Cl.[7] ..... B67B 7/04; B67B 7/44

(52) U.S. Cl. ..... 81/3.09; 81/3.48; 81/3.47; 81/3.36

(58) Field of Search ..... 81/3.09, 3.36, 81/3.29, 3.39, 3.45, 3.47, 3.48, 3.35, 3.55, 3.57

(56) References Cited

U.S. PATENT DOCUMENTS

| | | | | | |
|---|---|---|---|---|---|
| 71,316 | A | | 11/1867 | McCoun | |
| 204,389 | A | | 5/1878 | Sperry | |
| 786,492 | A | * | 4/1905 | Garimaldi | 81/3.09 |
| 1,213,034 | A | | 1/1917 | Sowers | |
| 1,218,757 | A | | 3/1917 | Gessler | |
| 1,670,199 | A | | 5/1928 | LaSchum | |
| 1,695,098 | A | | 12/1928 | Hiering | |
| 1,975,606 | A | * | 10/1934 | Hoegger | 81/3.09 |
| 2,084,194 | A | * | 6/1937 | Frank | 7/155 |
| 2,164,191 | A | | 6/1939 | Knudsen | 65/46 |
| 2,714,409 | A | | 8/1955 | Primrose | |
| 2,837,946 | A | * | 6/1958 | Berkman | 81/3.09 |
| 2,886,994 | A | | 5/1959 | Hanson | 81/3.35 |
| 4,437,359 | A | * | 3/1984 | Dejoux et al. | 81/3.09 |
| 4,584,911 | A | | 4/1986 | Cellini | 81/3.36 |
| 4,996,895 | A | | 3/1991 | Brucart Puig | 81/3.09 |
| 5,285,543 | A | | 2/1994 | Rowe | 7/138 |
| 5,454,282 | A | | 10/1995 | Del Mistro | 81/3.48 |
| 5,535,644 | A | | 7/1996 | Paul Alexandre et al. | 81/3.09 |
| 5,829,965 | A | * | 11/1998 | Rubalcava | 7/151 |
| 6,101,900 | A | * | 8/2000 | Traspuesto Miguel | 81/3.48 |
| 6,415,689 | B2 | * | 7/2002 | Castellani et al. | 81/3.47 |

FOREIGN PATENT DOCUMENTS

| | | |
|---|---|---|
| GB | 2091227 | 7/1982 |

* cited by examiner

*Primary Examiner*—D. S. Meislin
(74) *Attorney, Agent, or Firm*—Thomas L. Adams

(57) ABSTRACT

The handle of a container opener has between its first and second end a pair of sidewalls. The handle has an underside with a concavity, a topside, and on the topside at the first end, a cap remover. A corkscrew and arm are each pivotally attached to the handle. The corkscrew can swing about a corkscrew axis between a deployed position and a stored position that is located between the sidewalls inside the concavity. The corkscrew in its stored position is shielded along at least most of its length. The corkscrew axis is closer to the second end than the first end. The arm can swing about an arm axis, which is closer than the corkscrew axis to the second end. The arm can operate as a fulcrum for the handle.

27 Claims, 2 Drawing Sheets

CONTAINER OPENER

BACKGROUND OF THE INVENTION

1. Field of the Invention

The present invention relates to openers designed to remove caps and extract corks from containers.

2. Description of Related Art

Numerous devices exist for opening bottles. Common openers include a metal stamping with a cantilevered tab struck from one end for hooking onto the edge of a bottle cap. A conventional corkscrew may have a helical screw on one end and a crossbar handle on the other end. See for example U.S. Pat. No. 71,316.

Known cork pullers have a corkscrew and a brace arm that are pivotally connected to a handle. For example, in U.S. Pat. No. 4,584,911 an arm 12 can be braced against a bottle so that handle 11 can be lifted to pull a cork using pivoted corkscrew 14. To deploy the corkscrew from its folded position, one may need to risk injury by placing a fingertip at the sharp end of the corkscrew and pulling. Alternatively, a user may take advantage of the undercut in handle 11 to grasp the corkscrew's body. An undercut deep enough to expose the corkscrew's body will weaken the handle. Also, the user's hand will be exposed to the turns of the corkscrew when it is folded into the handle and the notch 16 (FIG. 2) is being used to remove bottle caps.

See also U.S. Pat. No. 4,996,895 (lever 8 has a bottle cap remover 14 and an undercut exposing corkscrew 2); and U.S. Pat. No. 5,454,282 (handle has arm 7 with cap-removing notch and an undercut that exposes pivoted corkscrew 3).

In U.S. Pat. No. 1,213,034 corkscrew 10 can be vertically adjusted using the notches in shank 11. Bucking plate 14 is used for leverage with the corkscrew. Implements 6 and 8 are made from a common plate and operate as a can-opening blade and a bottle cap remover, respectively. Applying downward pressure when screwing the corkscrew 10 will be difficult since the corkscrew is located at the very end of handle 1. Also, if the user tries to place a hand near the corkscrew's pivot pin 3, the user's hand will be placed against the sharp blade 6. See also U.S. Pat. No. 204,389 (crossbar B turns corkscrew through jointed shaft that would tend to fold when downward pressure is applied to the corkscrew).

In U.S. Pat. No. 1,695,098 a bottle opener is in the form of an elongated shell having a hook at one end for grasping the underside of a bottle cap. This hook is integral with the shell and is unsupported so that hook will tend to bend during use. This device also incorporates a corkscrew that is pivoted about a transverse axis near the center of the shell. Swinging the corkscrew from a retracted stored position will be difficult since the corkscrew will be buried inside the shell.

U.S. Pat. No. 1,218,757 shows a bottle opener having a corkscrew at one end, and a hook for removing a bottle cap on the other end. A tube that sheathes the corkscrew can be removed and inserted though a hole at the hooked end to serve as a handle for working the corkscrew. Forming a hole in the hooked end unnecessarily complicates and lengthens the hooked end. Moreover, the tube and corkscrew can be separated and misplaced. See also U.K. Patent Application GB 2091227 and U.S. Pat. No. 2,164,191.

For the corkscrew of U.S. Pat. No. 1,670,199, a conventional T-shaped structure was supplemented with an annular groove, so that the device can also be used to remove a conventional bottle cap. Again, the tube and corkscrew can be separated and misplaced. See U.S. Pat. No. 2,886,994 for another combined corkscrew and bottle cap remover. See also U.S. Pat. Nos. 2,714,409 and 5,285,543.

Another known bottle opener employed a metal tube notched at one end to provide a lip that can be used to remove a bottle cap. A disadvantage with this device is that the lip must be provided by an undercut and the entire device unnecessarily has the same strength as the lip. Also, this device lacks a corkscrew accessory. Furthermore, the device is not easily fabricated.

In U.S. Pat. No. 5,535,644 a notched rectangular tube is fitted with a tab 20 for removing a bottle cap. A corkscrew stored inside the tube can be removed and inserted in transverse holes in the tube, which then acts as a handle for the corkscrew. A disadvantage with this arrangement is that the tube and corkscrew can be separated and one of them can be misplaced. See also U.S. Pat. No. 4,949,600 (bottle opener with discrete blade).

See also U.S. Pat. Nos. 3,902,226; and 5,169,305.

Accordingly, there is a need for an improved opener that is relatively effective and employs a convenient and efficient structure.

SUMMARY OF THE INVENTION

In accordance with the illustrative embodiments demonstrating features and advantages of the present invention, there is provided a container opener with a handle, a corkscrew and arm. The corkscrew and the arm are each pivotally attached to the handle. The handle has between a first and a second end a pair of sidewalls. The handle has a cap remover at the first end. The corkscrew can swing about a corkscrew axis between a deployed position and a stored position that is located between the sidewalls. The corkscrew in its stored position is shielded along at least most of its length. The corkscrew axis is closer to the second end than the first end. The arm can swing about an arm axis, which is closer than the corkscrew axis to the second end. The arm can operate as a fulcrum for the handle.

According to another aspect of the invention, a container opener includes a handle having an underside with a concavity, a topside, and a cap remover on the topside. Also included is a corkscrew that is pivotally attached to the handle for swinging about a corkscrew axis between a deployed position and a stored position located inside the concavity. The opener also has an arm pivotally attached to the handle to swing about an arm axis.

By employing apparatus of the foregoing type, an improved container opener is achieved. A preferred embodiment employs a handle that has on its topside a notch with a metal tab that operates as a cap remover. Preferably, a corkscrew is mounted on a pivoted block and can swing into a concavity in the handle for storage. When moved into the storage position, a boss in the preferred block can snap into a hole in the handle. A preferred bracing arm is also pivoted to the handle and can swing into a closed position to cover the stored corkscrew. The arm can fit over the corkscrew and a ledge on the arm can fit into notches in the handle. The block and corkscrew can be deployed by pressing a stub on the block through an access hole in the handle. After the corkscrew is screwed into a bottle cork, the arm's ledge can be placed against the mouth of a bottle, so that the handle can be used as a lever to pull a cork out of a bottle.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figures 1, 2, 3, 4:
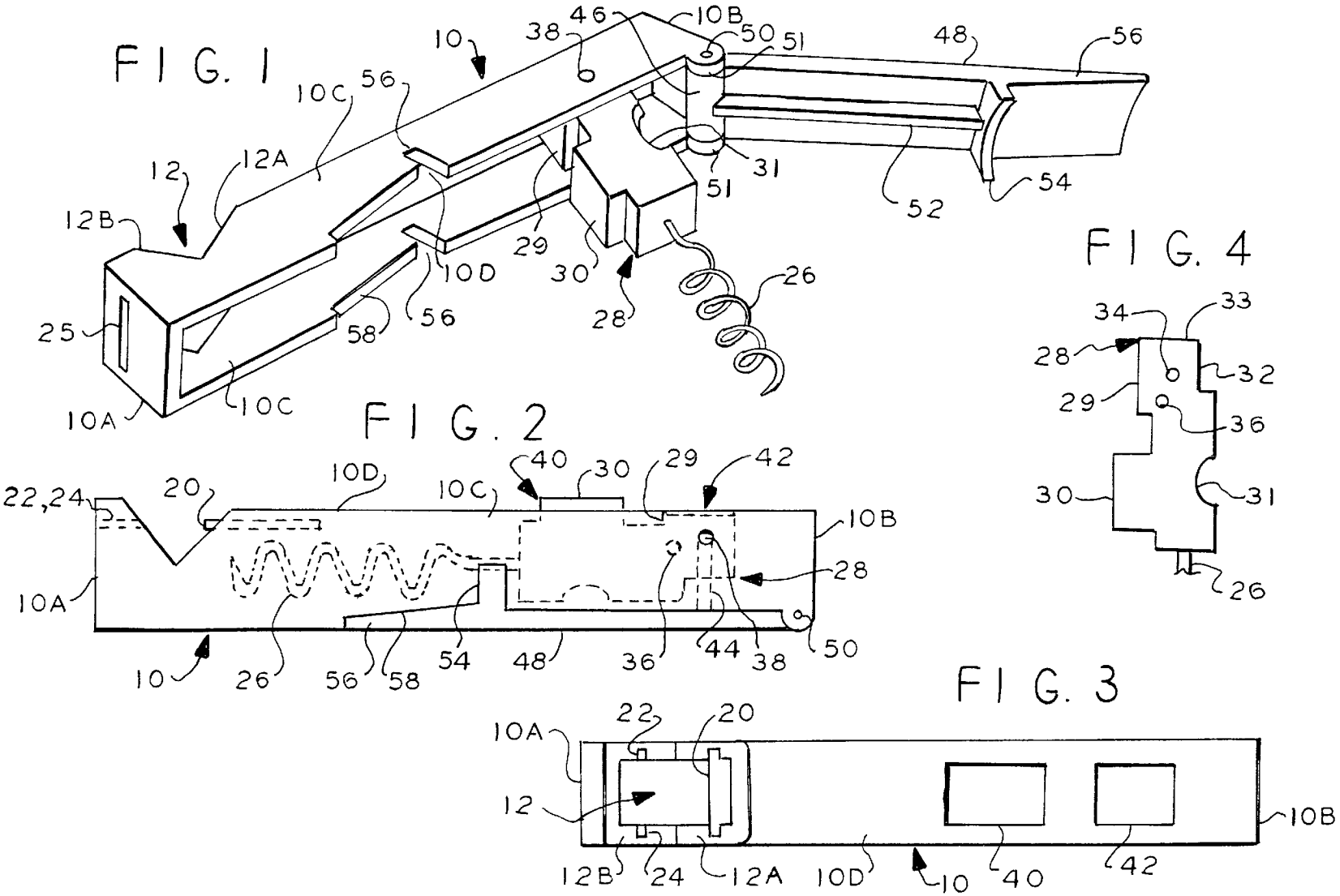
FIG. 1 is perspective view of a container opener in accordance with principles of the present invention.
FIG. 2 is a side elevational view of the opener of FIG. 1.
FIG. 3 is a plan view of the topside of the opener of FIG. 1.
FIG. 4 is a detailed side view of the supporting block for the corkscrew of FIG. 1.

Referring to FIGS. 1–8, a container opener is shown as a handle 10 in the form of a rectangular trough. A first end 10A of handle 10 has on its topside a V-shaped notch 12. The notch 12 has pair of opposing banks, namely a proximal bank 12A and distal bank 12B. Since handle 10 has a hollow or concavity in the region of notch 12, each of these two banks are in the form of a pair of parallel edges. The distal bank 12B is higher since first end 10A is taller.

Preferably, the main body of handle 10 has over most of its length a U-shaped cross-section formed by parallel sidewalls 10C and transverse partition 10D. Preferably, handle 10 has at second end 10B a width and height of 0.637 inch (1.62 cm) and a wall thickness of 0.094 inch (0.24 cm). First end 10A has the same width and wall thickness but has a greater height, namely, 0.712 inch (1.8 cm). The overall length of handle 10 is 4.07 inches (10.34 cm). It will be appreciated that all of the foregoing dimensions are exemplary, and that in other embodiments these dimensions can be altered depending upon the desired size, strength, structural rigidity, etc. Also, while a rectangular trough is illustrated, in some embodiments the perimeter may be partially polygonal, cylindrical, or some other shape. Furthermore in some embodiments, the handle need not be hollow or need only be partly hollow.

Referring to FIGS. 5–8, pair of longitudinal slots 14 and 16 are formed in opposite interior faces of walls 10C of handle 10. Slots 14 and 16 run from the proximal bank 12A into the handle 10 a distance of 0.625 inch (1.6 cm), although other dimensions are contemplated. A span of the handle lying between slots 14 and 16 is removed to provide a window opening 18 along approximately 60% of the length of slots 14 and 16. Still, in some embodiments, window 18 may be of a different size or may be eliminated altogether.

Figure 5:
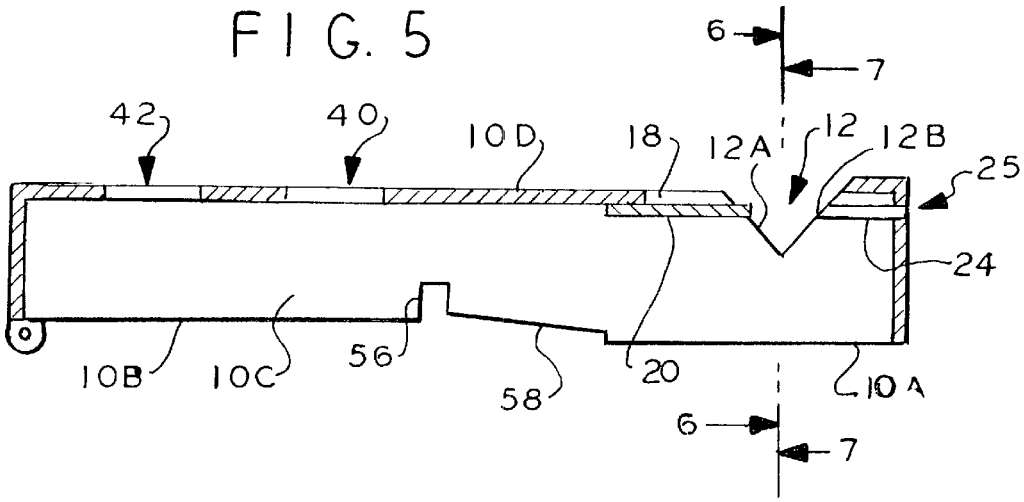
FIG. 5 is a longitudinal sectional view of the handle of FIG. 1 with the corkscrew and arm removed for illustrative purposes.
Figure 8:
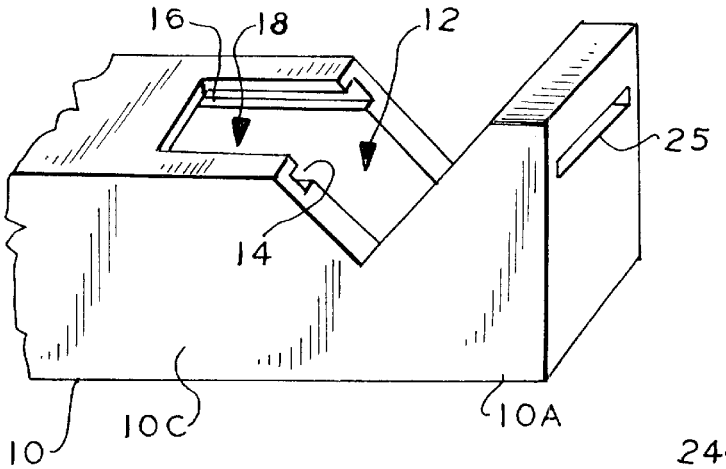
FIG. 8 is a detailed perspective view of a first end of the handle of FIG. 5 with the tab removed for illustrative purposes.

FIG. 5 shows a tab 20 underneath window 18 and mounted in slots 14 and 16 (FIG. 8). Tab 20 is preferably a thin steel plate, about 0.03 inch (0.08 cm) thick, although other thicknesses are contemplated for other embodiments. Tab 20 is designed to fit in the slots 14 and 16 and extend into the notch 12 about 1 mm. Accordingly, tab 20 will be about 0.49 inch (1.24 cm) wide and 0.63 inch (1.6 cm) long. As explained further hereinafter, tab 20 is sized to project into notch 12 an amount sufficient to allow tab 20 to catch the underside of a container cap, such as a bottle cap.

In other embodiments, tab 20 can be secured inside handle 10 in alternate fashions such as by glueing, riveting, by means of internal support brackets or by other means. Also, in some embodiments where the material of handle 10 is sufficiently strong, the tab may be replaced with an integral lip that is formed integrally with the handle (although use of a discrete tab is preferred to avoid the expense of making the entire handle as strong as the tab). In this preferred embodiment, handle 10 is formed of a molded plastic.

A pair of grooves 22 and 24 are formed on opposing inside faces of walls 10C at end 10A of handle 10. Grooves 22 and 24 align with longitudinal slots 14 and 16, respectively. Accordingly, tab 20 (FIG. 5) can be installed by sliding the tab through opening 25 in end 10A, along grooves 22 and 24, and then into slots 14 and 16. In other embodiments, the size of the opening in end 10A can simply be increased to provide clearance for the passage of tab 20. Alternatively, if notch 12 is sufficiently large or the tab 20 is sufficiently short, tab 20 can be inserted into longitudinal slots 14 and 16 by insertion directly through notch 12.

A helical device is shown herein as a corkscrew 26 attached to a block 28. Block 28 is molded, with the corkscrew element 26 being embedded therein. Corkscrew 26 is preferably a pointed steel rod that has been coiled into a spiral having about four turns; although a different number of turns may be used in alternate embodiments.

Block 28 is a prism with the complex outline shown in FIG. 4. Projecting from one side of block 28 is a boss 29 and a stub 30, useful for the purposes to be described presently. Formed on the other side of block 28 is a cylindrical valley 31 and a flat depression 32. Block 28 has a hole 34 for accepting a pin 38 (FIGS. 1 and 2) to create a corkscrew axis. Block 28 also has adjacent to hole 34 a spring-loaded spherical member 36 that acts as an angular detent, in a manner to be described presently.

In FIGS. 1–3, block 28 is shown mounted on pin 38 between sidewalls 10C to swing about its corkscrew axis. In FIG. 2, corkscrew assembly 26/28 is shown folded into a stored position inside the concavity of handle 10 between side walls 10C. In this stored position, stub 30 will project through access hole 40 in partition 10B. At the same time, boss 29 of block 28 will snap into the holding hole 42 in partition 10D to act as a detent, keeping the corkscrew in the stored position.

In FIG. 1, corkscrew assembly 26/28 is shown swung from the concavity of handle 10 to a deployed position. In this position, the face of block 28 opposite corkscrew 26 (face 33 of FIG. 4) will snap into holding hole 42 (FIG. 3).

Moreover, when corkscrew assembly 26/28 is in the deployed position, the spring-loaded detent 36 (FIGS. 2 and 4) in block 28 will snap into internal depression 44 (FIG. 2), which is part of the angular detent. Specifically, depression 44 is a groove molded on the inside face of one (or both) of the sidewalls 10C of handle 10. When the corkscrew assembly 26/28 is transversely deployed, detent member 36 and pin 38 are aligned with groove 44. Groove 44 can also provide an installation (or disassembly) path between sidewalls 10C for detent member 36 when moving block 28 in an unfastened condition. Corkscrew assembly 26/28 can also be swung past the deployed position. Valley 31 provides clearance around cylindrical hub 46 under those circumstances.

Hub 46 is part of arm 48, which pivots about the arm axis formed by pin 50. Pin 50 extends through hub 46 and the ears 51 that extend from the sidewalls 10C at end 10B. Arm 48 has on its inside face a reinforcing rib 52 that runs from hub 46 to a transverse ledge 54. Ledge 54 is designed to fit into notches 56 in sidewalls 10C. Also, the distal edge of ledge 54 is rounded to form a cradle that presses against the root of corkscrew 26 to keep the corkscrew in place, as shown in FIG. 2. The distal end of arm 48 forms a wedge-shaped blade 56 with a rounded underside that cradles and holds corkscrew 26 in place, as shown in FIG. 2. The edge of sidewalls 10C adjacent to notches 56 have a ramped shape that matches the taper of blade 56 to create the conformal mating shown in FIG. 2, where arm 48 is shown in its closed position.

Figure 9:
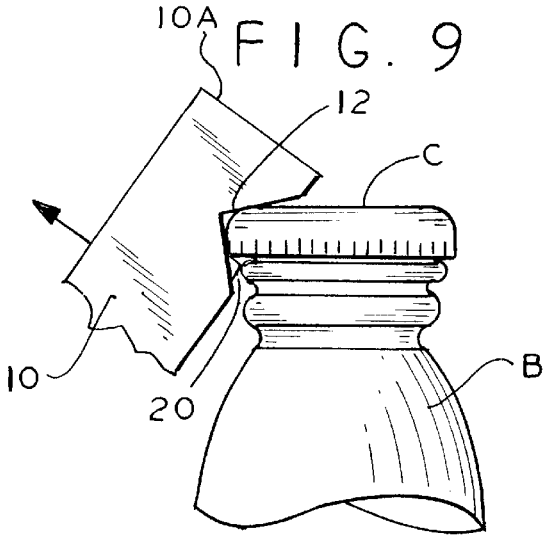
FIG. 9 is a detailed, side view of the opener of FIG. 1 being used to remove a cap on a container.
Figure 7:
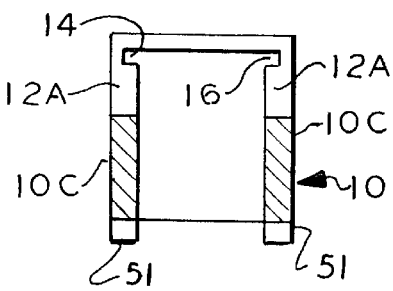
FIG. 7 is a cross-sectional view taken along line 7—7 of FIG. 5.

To facilitate an understanding of the principles associated with the foregoing apparatus, its operation will be briefly described. The opener may be assembled as shown in FIG. 2 with tab 20 in place and the corkscrew 26 stored inside handle 10. In this condition, the device can be readily used to open a container B as shown in FIG. 9.

Container B may be a conventional bottle sealed with a container cap C. Notch 12 may be positioned as shown around the edge of cap C with the projecting tab 20 catching the rim of cap C. In this position, the handle 10 may be lifted, that is, rotated clockwise as indicated in FIG. 9. Accordingly, handle 10 is then a lever, which is used to pry open cap C to remove the cap from bottle B.

In its stored position, corkscrew 26 is shielded so that the user's fingers do not engage the turns of the corkscrew when the cap remover at notch 12 is employed. Specifically, the user's fingers will wrap around the topside formed by partition 10D and pull upwardly when removing the cap C shown in FIG. 9. The fingers will be shielded however by partition 10D and will never engage the turns of corkscrew 26. Moreover, the sidewalls 10C are tall enough that corkscrew 26 will not rise above the edges of the sidewalls. In principle, a small portion of the corkscrew 26 can rise above the ramped edge 58, but this portion will be shielded by the blade 56 when in its closed position.

To use corkscrew 26, the user will first deploy arm 48 from the closed position shown in FIG. 2. Next, the user will press stub 30 to rotate block 28 about pivot pin 38. Significantly, the user need not insert a finger into the concavity of handle 10 and run the risk of injury from the sharp tip of the corkscrew 26. As the block 28 moves, boss 29 will snap out of holding hole 42. Once the corkscrew 26 is partially deployed, the user may grasp its central section or the block 28 and swing the assembly to the deployed position shown in FIG. 1. When corkscrew assembly 26/28 reaches the deployed position, detent member 36 (FIGS. 2 and 4) will snap into the groove 44 to hold the assembly in its deployed position. Also face 33 (FIG. 4) will snap into holding hole 42 (FIG. 3).

Figure 10:
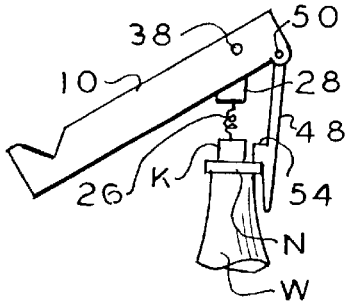
FIG. 10 is a detailed, side view of the opener of FIG. 1 being used to pull a cork from a bottle.
Figure 6:
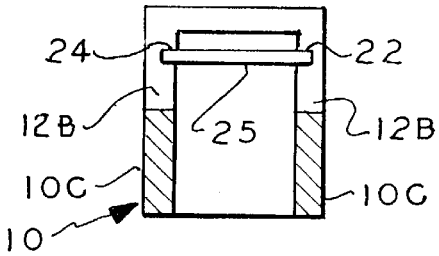
FIG. 6 is a cross-sectional view taken along line 6—6 of FIG. 5.

With the arm 48 swung outwardly to a position approximately parallel to the length of handle 10, the user may now insert the tip of corkscrew 26 into the cork K of bottle W, as shown in FIG. 10. In the usual fashion, the handle and arm 46 may be rotated to screw corkscrew 26 into the cork K. Next, arm 48 can be swung down so that ledge 54 rests on the lip N at the neck of the bottle W. With the configuration shown in FIG. 10, arm 48 may act as a fulcrum for handle 10. Specifically, the user may grasp the underside of handle 10 (that is, the side opposite topside 10D) and pivot the handle about the pivot pin 50. Consequently, a mechanical advantage is achieved at pivot pin 38 so that corkscrew 26 rises and cork K is pulled out of bottle W. After being removed from the bottle W, the cork K can be unscrewed from the corkscrew 26 and dealt with appropriately.

Thereafter, corkscrew assembly 26/28 can be folded from its deployed position to the stored position shown in FIG. 2. This pulls detent member 36 from groove 44, while the inside end 33 of block 28 snaps out of the holding hole 42. In the stored position shown in FIG. 2, boss 29 snaps into holding hole 42. At the same time, stub 30 protrudes through access hole 40. Finally, arm 48 can be swung into the closed position of FIG. 2 so that ledge 54 snaps into notch 56. In this position, ledge 54 cradles the shank of corkscrew 26 while the rounded underside of blade 56 presses against the turns of corkscrew 26.

It is to be appreciated that various modifications may be implemented with respect to the above described preferred embodiments. The shape of the block that supports the corkscrew can be varied and in some embodiments, no block will be employed. Also the relative positions of the axes for the corkscrew and the arm can be varied in other embodiments. In some embodiments, the metal tab of the cap remover can be positioned differently and secured differently or in some instances eliminated and formed as an integral tab in the handle body. Moreover, the various dimensions of the handle, the corkscrew and other elements of the opener may be altered depending upon the expected size of the caps and containers, as well as on the desired size, strength and reliability of the opener. Furthermore, while a V-shaped notch is shown in one end of the handle, in other embodiments the notch may be rounded, undercut or exhibit another shape. Alternatively, the notch may be eliminated in favor of a discrete cap remover that may be attached to the handle. Also, the cap removing structure can be located at various positions on the handle. While the handle body is preferably formed of molded plastic, in other embodiments metal, ceramic or other materials can be used instead. Also, in some embodiments the handle may be formed from interlocking or telescoping parts that are attached together by various means in order to simplify the molding or manufacturing of the handle.

Obviously, many modifications and variations of the present invention are possible in light of the above teachings. It is therefore to be understood that within the scope of the appended claims, the invention may be practiced otherwise than as specifically described.

What is claimed is:

1. A container opener comprising:

a handle having between a first and a second end a partition with a topside and an underside and a pair of sidewalls on either side of said partition, said handle having a cap remover on said topside at said first end;

a corkscrew pivotally attached to said handle for swinging about a corkscrew axis between a deployed position under said underside and a stored position located between said sidewalls, said corkscrew in its stored position being shielded along at least most of its length, the corkscrew axis being closer to said second end than said first end; and an arm pivotally attached to said handle to swing about an arm axis, the arm axis being closer than the corkscrew axis to the second end, said arm being operable as a fulcrum for said handle, said arm being operable to swing into a closed position against said handle to cover said corkscrew in its stored position, said arm being operable to snap into its closed position.

2. A container opener according to claim 1 wherein said corkscrew has a stub positioned to project beyond said handle when said corkscrew is in said stored position to allow finger pressure on said stub to swing said corkscrew about said corkscrew axis and out of said stored position.

3. A container opener according to claim 1 wherein said corkscrew is pivotally supported between said sidewalls.

4. A container opener according to claim 1 wherein said handle has an angular detent for holding the corkscrew in said deployed position.

5. A container opener according to claim 4 wherein said angular detent comprises:

a spring-loaded member between said handle and said corkscrew.

6. A container opener according to claim 1 wherein said arm has a transverse tongue that is operable to engage a bottle mouth after said corkscrew is embedded in a cork, so that said arm can act as a fulcrum for said handle to allow extraction of the cork by lifting said handle.

7. A container opener according to claim 1 wherein said arm has a transverse ledge that, in said closed position, engages and holds said corkscrew in its stored position.

8. A container opener according to claim 1 wherein said sidewalls have at least one notch, said arm having a transverse ledge that, in said closed position, engages said at least one notch to hold said arm in its closed position.

9. A container opener according to claim 1 wherein said arm is operable to swing at least 180°.

10. A container opener according to claim 1 wherein said handle has between said sidewalls said partition shielding at least a portion of said corkscrew in its stored position.

11. A container opener according to claim 1 wherein said cap remover comprises:

a notch extending transversely across said handle for engaging a container cap.

12. A container opener according to claim 11 wherein said notch at said first end is a V-shaped notch.

13. A container opener according to claim 11 wherein said notch has a proximal bank and a higher distal bank.

14. A container opener according to claim 11 wherein said notch has a pair of banks, said opener comprising:

a rigid tab mounted at one of said banks and extending partially into said notch for engaging said container cap.

15. A container opener according to claim 14 wherein one of said banks has a longitudinal slot, said rigid tab being mounted in said longitudinal slot.

16. A container opener according to claim 15 wherein said rigid tab is mounted at a proximal one of said banks of said notch, said first end having a an opening extending axially to said notch to give clearance for installing said rigid tab through said first end into said longitudinal slot.

17. A container opener comprising:

a handle having between a first and a second end a partition with a topside and an underside and a pair of sidewalls on either side of said partition, said handle having a cap remover on said topside at said first end, said handle having between said sidewalls a partition with an access holes;

a corkscrew pivotally attached to said handle for swinging about a corkscrew axis between a deployed position under said underside and a stored position located between said sidewalls, said corkscrew in its stored position being shielded along at least most of its length, the corkscrew axis being closer to said second end than said first end, said corkscrew having a stub positioned to project beyond said handle when said corkscrew is in said stored position to allow finger pressure on said stub to swing said corkscrew about said corkscrew axis and out of said stored position, said stub projecting through said access hole when said corkscrew is in said stored position; and an arm pivotally attached to said handle to swing about an arm axis, the arm axis being closer than the corkscrew axis to the second end, said arm being operable as a fulcrum for said handle.

18. A container opener comprising:

a handle having between a first and a second end a partition with a topside and an underside and a pair of sidewalls on either side of said partition, said handle having a cap remover on said topside at said first end;

a corkscrew pivotally attached to said handle for swinging about a corkscrew axis between a deployed position under said underside and a stored position located between said sidewalls, said corkscrew in its stored position being shielded along at least most of its length, the corkscrew axis being closer to said second end than said first end, said handle having an angular detent for holding the corkscrew in said deployed position, said angular detent having an internal depression on said handle for engaging and holding said corkscrew; and an arm pivotally attached to said handle to swing about an arm axis, the arm axis being closer than the corkscrew axis to the second end, said arm being operable as a fulcrum for said handle.

19. A container opener comprising:

a handle having between a first and a second end a partition with a topside and an underside and a pair of sidewalls on either side of said partition, said handle having a cap remover on said topside at said first end;

a corkscrew pivotally attached to said handle for swinging about a corkscrew axis between a deployed position under said underside and a stored position located between said sidewalls, said corkscrew in its stored position being shielded along at least most of its length, the corkscrew axis being closer to said second end than said first end, said handle having an angular detent for holding the corkscrew in said deployed position, said angular detent having a holding hole in said handle for receiving a portion of said corkscrew in order to hold it in said deployed position; and an arm pivotally attached to said handle to swing about an arm axis, the arm axis being closer than the corkscrew axis to the second end, said arm being operable as a fulcrum for said handle.

20. A container opener comprising:

a handle having an underside with a concavity, a topside, and a cap remover on said topside;

a corkscrew pivotally attached to said handle for swinging about a corkscrew axis between a deployed position under said underside and a stored position located inside said concavity; and an arm pivotally attached to said handle to swing about an arm axis, said corkscrew axis being located on said handle between said cap remover and said arm axis, said arm being operable to swing into a closed position against said handle to cover said corkscrew in its stored position; said arm being operable to snap into its closed position.

21. A container opener according to claim 20 wherein said handle comprises:

a pair of sidewalls having between them said topside, said topside having an access hole, said stub projecting through said access hole when said corkscrew is in said stored position.

22. A container opener according to claim 20 wherein said handle comprises:

a pair of sidewalls having at least one notch, said arm having a transverse ledge that, in said closed position, engages said at least one notch to hold said arm in its closed position.

23. A container opener according to claim 20 wherein said cap remover comprises:

a notch extending transversely across said handle for engaging a container cap.

24. A container opener according to claim 23 wherein said notch is a V-shaped notch.

25. A container opener according to claim 23 wherein said notch has a pair of banks, said opener comprising:

a rigid tab mounted at one of said banks and extending partially into said notch for engaging said container cap.

26. A container opener comprising:

a handle having an underside with a concavity, a topside, and a cap remover on said topside;

a corkscrew pivotally attached to said handle for swinging about a corkscrew axis between a deployed position under said underside and a stored position located inside said concavity, said corkscrew having a stub positioned to project beyond said topside of said handle when said corkscrew is in said stored position to allow finger pressure on said stub to swing said corkscrew about said corkscrew axis and out of said stored position; and an arm pivotally attached to said handle to swing about an arm axis, said corkscrew axis being located on said handle between said cap remover and said arm axis.

27. A container opener comprising:

a handle having an underside with a concavity, a topside, and a cap remover on said topside;

a corkscrew pivotally attached to said handle for swinging about a corkscrew axis between a deployed position under said underside and a stored position located inside said concavity; and an arm pivotally attached to said handle to swing about an arm axis, said corkscrew axis being located on said handle between said cap remover and said arm axis, said arm being operable to swing into a closed position against said handle to cover said corkscrew in its stored position, said arm having a transverse ledge that, in said closed position, engages and holds said corkscrew in its stored position.

* * * * *